US009216339B2

(12) United States Patent
Chen

(10) Patent No.: US 9,216,339 B2
(45) Date of Patent: Dec. 22, 2015

(54) BALL NET STRUCTURE

(71) Applicant: Benjamin Chen, Taichung (TW)

(72) Inventor: Benjamin Chen, Taichung (TW)

( * ) Notice: Subject to any disclaimer, the term of this patent is extended or adjusted under 35 U.S.C. 154(b) by 168 days.

(21) Appl. No.: 13/970,685

(22) Filed: Aug. 20, 2013

(65) Prior Publication Data

US 2015/0057109 A1 Feb. 26, 2015

(51) Int. Cl.

| | |
|---|---|
| ***A63B 61/02*** | (2006.01) |
| ***A63B 61/00*** | (2006.01) |
| ***A63B 69/00*** | (2006.01) |
| ***A63B 63/00*** | (2006.01) |
| *A63B 71/02* | (2006.01) |

(52) U.S. Cl.

CPC ..... *A63B 61/02* (2013.01); *A63B 61/003* (2013.01); *A63B 63/004* (2013.01); *A63B 69/0002* (2013.01); *A63B 2063/005* (2013.01); *A63B 2071/024* (2013.01); *A63B 2209/02* (2013.01); *A63B 2209/10* (2013.01); *A63B 2210/50* (2013.01); *A63B 2243/0083* (2013.01); *A63B 2243/0087* (2013.01); *A63B 2243/0095* (2013.01)

(58) Field of Classification Search

CPC ..... A63B 61/00; A63B 61/003; A63B 61/02; A63B 61/04; A63B 1/00; A63B 1/003; A63B 1/02

USPC ..... 473/494, 490, 491, 492, 459, 469, 473/473–478, 43–435; 273/407, 398–402; 256/54, 68

See application file for complete search history.

(56) References Cited

U.S. PATENT DOCUMENTS

| | | | | | |
|---|---|---|---|---|---|
| 4,191,361 | A * | 3/1980 | Jensen | 256/12.5 |
| 4,357,019 | A * | 11/1982 | Wouters | 473/473 |
| 5,176,344 | A * | 1/1993 | Eberhard | 248/156 |
| 5,333,880 | A * | 8/1994 | Allbright | 473/493 |
| 5,954,308 | A * | 9/1999 | Lane et al. | 248/539 |
| 6,857,607 | B1 * | 2/2005 | Burris | 248/165 |
| 2003/0122390 | A1 * | 7/2003 | Slauf | 294/19.1 |
| 2005/0227794 | A1 * | 10/2005 | Bouffard et al. | 473/478 |
| 2010/0304902 | A1 * | 12/2010 | Holland et al. | 473/478 |
| 2013/0252766 | A1 * | 9/2013 | Nelson et al. | 473/422 |

OTHER PUBLICATIONS

Bison VB7000NS Carbon Max Carbon Fiber Composite Volleyball Net System, Jan. 31, 2015.*

* cited by examiner

*Primary Examiner* — Gene Kim
*Assistant Examiner* — Rayshun Peng
(74) *Attorney, Agent, or Firm* — Alan D. Kamrath; Kamrath IP Lawfirm, P.A.

(57) ABSTRACT

A ball net structure includes: a base; two tilted metallic pipes flanking the base and having front ends receiving two resilient rods, respectively, with the tilted metallic pipes longer than the resilient rods, allowing the resilient rods to bend and achieve optimal curvature and produce the evenest and largest tensile force; a net body stretched by and between the resilient rods to keep being flat and tight; a plastic sheet edge-binder disposed at each of four edges of the net body; clamping elements for clamping first and second edges of the net body; two net-clamping shells for clamping the clamping elements, the plastic sheet edge-binder, and the first and second edges of the net body; and at least two nails disposed on each of the net-clamping shells to fix the net-clamping shells in place, achieving uniform distribution of stress and extending the service life of the net body.

12 Claims, 15 Drawing Sheets

BALL NET STRUCTURE

BACKGROUND OF THE INVENTION

1. Technical Field

The present invention relates to nets for ball games and, more particularly, to a ball net structure characterized by an optimal ratio of rigid metallic pipe to flexible resilient rod by length, allowing the resilient rod to bend to attain optimal curvature and produce the largest and evenest tensile force, and characterized in that two high-rigidity net-clamping shells clamp a plastic sheet edge-binder and a first edge or a second edge of the net body and are fixed in place with at least two nails to spread stress uniformly, to enable a net body to bear greater stress, and to extend the service life of the ball net structure.

2. Description of Related Art

Conventional ball games, such as tennis, volleyball, beach volleyball, and badminton, require a net for separating the two opposing players or teams. According to the prior art, a net fastening process entails erecting two metallic bars on two edges of a net and then fastening the two edges of the net to the two metallic bars, respectively. However, metal lacks elasticity, and thus it is impossible to stretch and tighten the net. As a result, the net is so flaccid that it does not function well but becomes boring to the players, thereby causing the players to reduce sport duration or frequency eventually. Furthermore, a structure made of steel or iron is not only heavy but also incapable of bending. Hence, to be bent to attain a curvature, it must be processed to attain a curvature, which is no easy job.

Although a conventional net body is peripherally provided with a plastic sheet edge-binder, the plastic sheet edge-binder is subjected directly to a tensile force, and the plastic sheet is too thin to bear a large tensile force. Furthermore, the tensile force is concentrated at the top and bottom of the two edges of the plastic sheet edge-binder. As a result, the top and bottom of the two edges of the plastic sheet edge-binder are susceptible to damage. Accordingly, the conventional net body is susceptible to damage and has a short service life.

Furthermore, it is inconvenient and takes time to erect and store the conventional net body. As a result, sports which require the conventional net body are relatively unpopular because of the aforesaid drawbacks of the conventional net body.

SUMMARY OF THE INVENTION

It is an objective of the present invention to provide a ball net structure characterized by an optimal ratio of rigid metallic pipe to flexible resilient rod by length, such that the high-flexibility resilient rods not only bend to attain optimal curvature but also produce the largest and evenest tensile force. The ball net structure of the present invention is further characterized by two high-rigidity net-clamping shells which clamp a plastic sheet edge-binder and a first edge or a second edge of the net body and are fixed in place with at least two nails to thereby achieve uniform distribution of stress, allow the net body to bear a relatively large stress, and extend the service life of the net body.

In order to achieve the above and other objectives, the present invention provides a ball net structure, comprising: a base; two tilted metallic pipes flanking the base and having front ends receiving two resilient rods, respectively, with a 2:1 ratio of metallic pipe to resilient rod by length approximately, such that the resilient rods bend to attain optimal curvature and produce the evenest and largest tensile force. Thus, a net body is evenly stretched by and between the resilient rods to keep being flat and tight under a uniform outward tensile force.

In order to achieve the above and other objectives, the present invention provides a ball net structure comprising: a net body having a first edge and a second edge, with a plastic sheet edge-binder disposed at each of the four edges of the net body; clamping elements for clamping the first edge and the second edge; a net-clamping shell of high rigidity for clamping the two clamping elements, the plastic sheet edge-binder, and the first or second edge of the net body; and at least two nails disposed on each of the net-clamping shells, spaced apart, and adapted to fix the net-clamping shells in place. The at least two nails enable the two clamping elements, the plastic sheet edge-binder, and the first or second edge of the net body to bear any force jointly and equally and thus to incur uniform distribution, rather than concentration, of stress, thereby extending the service life of the net body.

DETAILED DESCRIPTION OF THE EMBODIMENTS OF THE INVENTION

The present invention provides a ball net structure.

Figure 1:
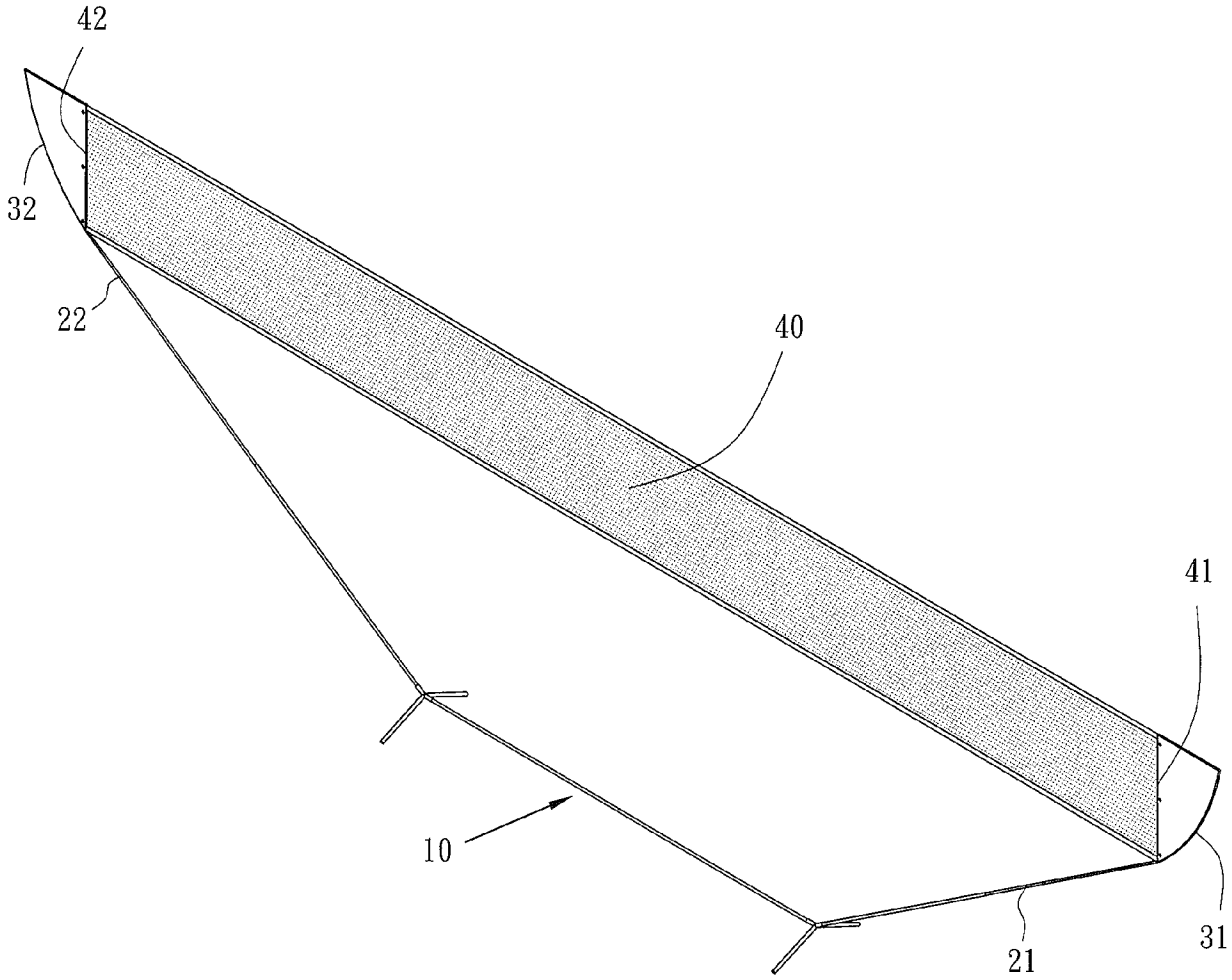
FIG. 1 is a perspective schematic view of a ball net structure which comes in the form of a badminton net body according to an embodiment of the present invention.
Figure 2:
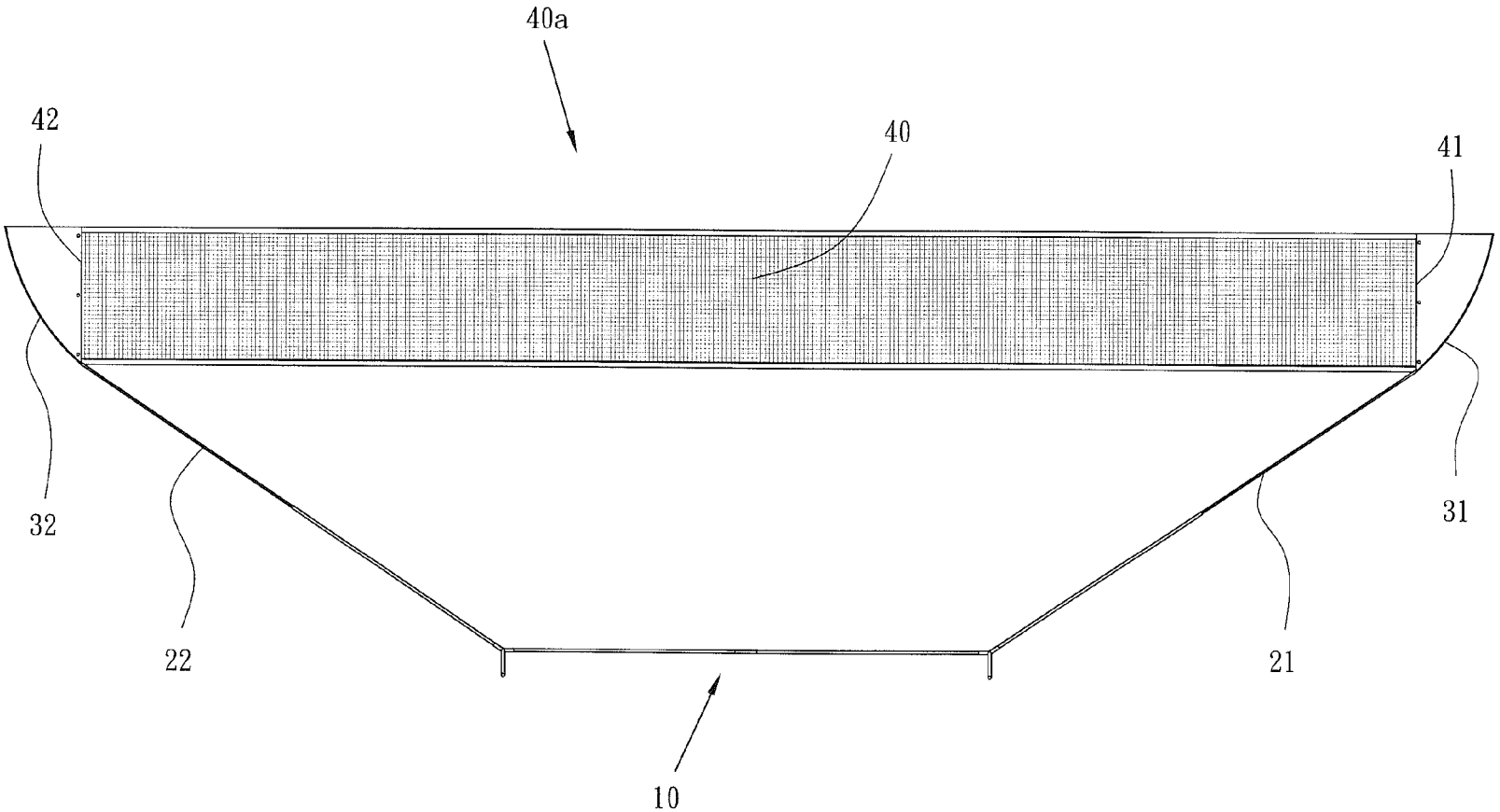
FIG. 2 is a front view of the ball net structure which comes in the form of a badminton net body according to an embodiment of the present invention.
Figure 3:
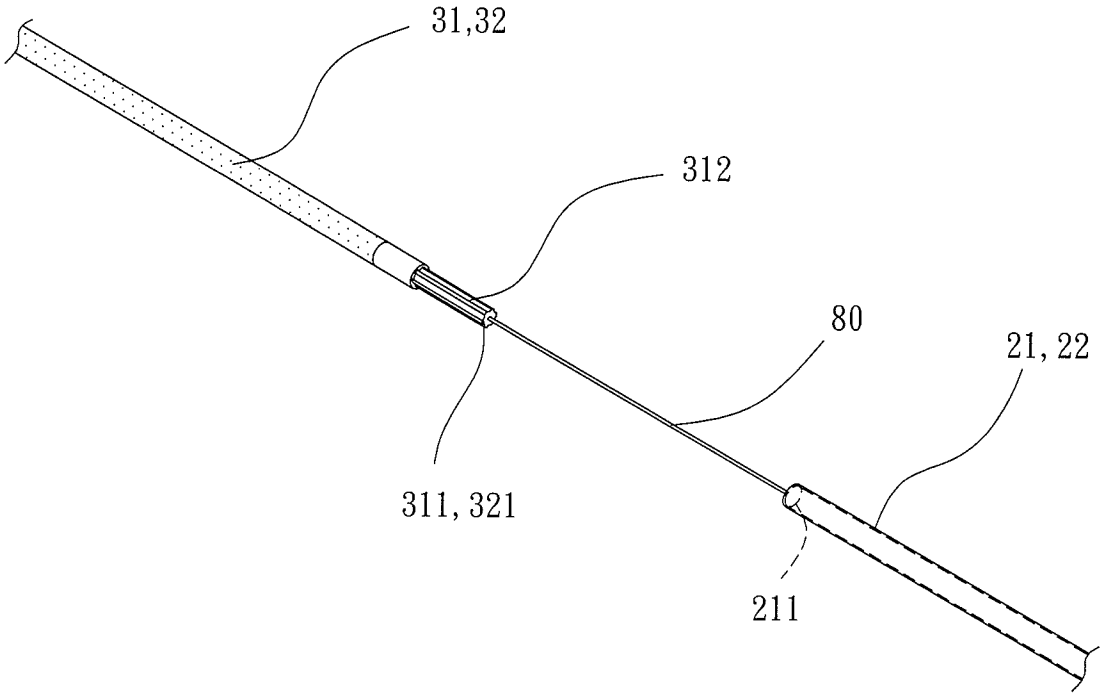
FIG. 3 is a partial perspective exploded view of a resilient rod and a metallic pipe connected thereto according to the present invention.

Referring to FIG. 1 through FIG. 3, the present invention provides a ball net structure which comprises a base 10, two tilted metallic pipes 21, 22, two resilient rods 31, 32, and a net body 40.

The base 10 is disposed on the ground.

The two tilted metallic pipes 21, 22 are insertedly disposed on two sides of the base 10 and titled outward.

The two resilient rods 31, 32 have insertion ends 311, 321, respectively. The insertion ends 311, 321 are inserted into the tilted metallic pipes 21, 22, respectively, and fixed in place. The tilted metallic pipes 21, 22 are longer than the resilient rods 31, 32, which are made from spherical fiber or carbon fiber, such that the resilient rods 31, 32 can bend in a manner to have optimal curvature and produce the evenest and largest tensile force.

In the embodiments of the present invention, the net body 40 comes in the form of a volleyball net body 40*b*, badminton net body 40*a*, beach volleyball net body, baseball training net body 40*d*, and tennis net body 40*c*, respectively. The net body 40 has a first edge 41 and a second edge 42. The first edge 41 and the second edge 42 are disposed around the two resilient rods 31, 32, respectively. With the two resilient rods 31, 32 each bending to produce a uniform outward tensile force, the net body 40 is kept flat and tight.

Referring to FIG. 3, an elastic cord 80 penetrates all the pipes and the tilted metallic pipes 21, 22 disposed at the base 10 according to the present invention, and the elastic cord 80 is coupled to the resilient rods 31, 32, such that not only can the resilient rods 31, 32 be dismounted quickly, but the resilient rods 31, 32 can also be mounted quickly in an assembly process while the elastic cord 80 is being pulled to thereby dispense with the hassle of looking for constituent components. Alternatively, the insertion ends 311, 321 of the resilient rods 31, 32 come in the form of retractable portions (not shown), respectively, for the resilient rods 31, 32 to be connected easily to hollow inner holes 211 inside the tilted metallic pipes 21, 22, respectively. Convolutions 312 are disposed at the periphery of the retractable portions, such that the resilient rods 31, 32 are coupled firmly to the tilted metallic pipes 21, 22, respectively.

Referring to FIG. 2, the ball net structure of the present invention comes in the form of the badminton net body 40*a* or a beach volleyball net body. The insertion ends 311, 321 of the two resilient rods 31, 32 are inserted into the two tilted metallic pipes 21, 22, respectively. Then, the first edge 41 and the second edge 42 of the badminton net body 40*a* are disposed around the two resilient rods 31, 32, respectively, in a manner that the two resilient rods 31, 32 bend to produce a uniform outward tensile force under which the badminton net body 40*a* is kept flat and tight.

Figure 4:
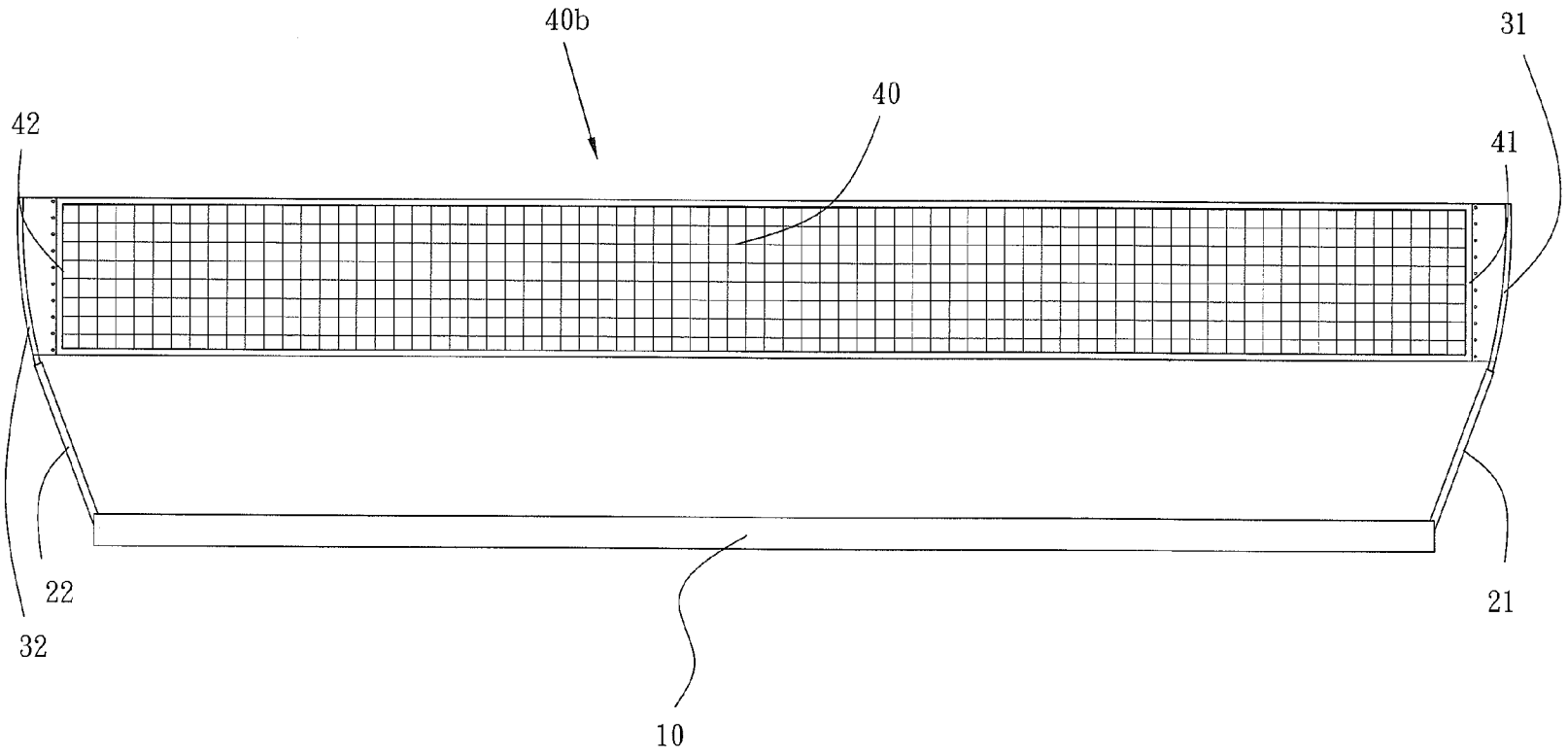
FIG. 4 is a front view of the ball net structure which comes in the form of a volleyball net body according to an embodiment of the present invention.

Referring to FIG. 4, the ball net structure of the present invention comes in the form of the volleyball net body 40*b* or a beach volleyball net body. The insertion ends 311, 321 of the two resilient rods 31, 32 are inserted into the two tilted metallic pipes 21, 22, respectively. Then, the first edge 41 and the second edge 42 of the volleyball net body 40*b* are disposed around the two resilient rods 31, 32, respectively, in a manner that the two resilient rods 31, 32 bend to produce a uniform outward tensile force under which the volleyball net body 40*b* is kept flat and tight.

Figure 5:
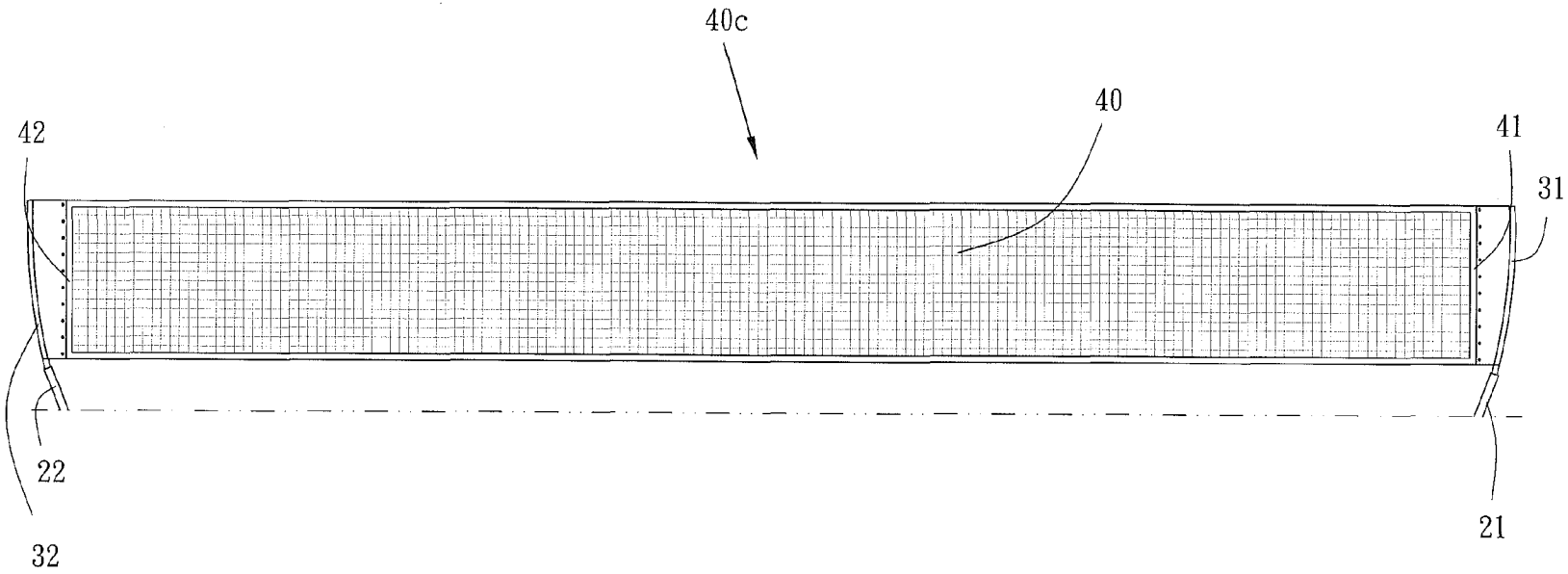
FIG. 5 is a front view of the ball net structure which comes in the form of a tennis net body according to an embodiment of the present invention.

Referring to FIG. 5, the ball net structure of the present invention comes in the form of the tennis net body 40*c*. The insertion ends 311, 321 of the two resilient rods 31, 32 are inserted into the two tilted metallic pipes 21, 22, respectively. Then, the first edge 41 and the second edge 42 of the tennis net body 40*c* are disposed around the two resilient rods 31, 32, respectively, in a manner that the two resilient rods 31, 32 bend to produce a uniform outward tensile force under which the tennis net body 40*c* is kept flat and tight.

Figure 6:
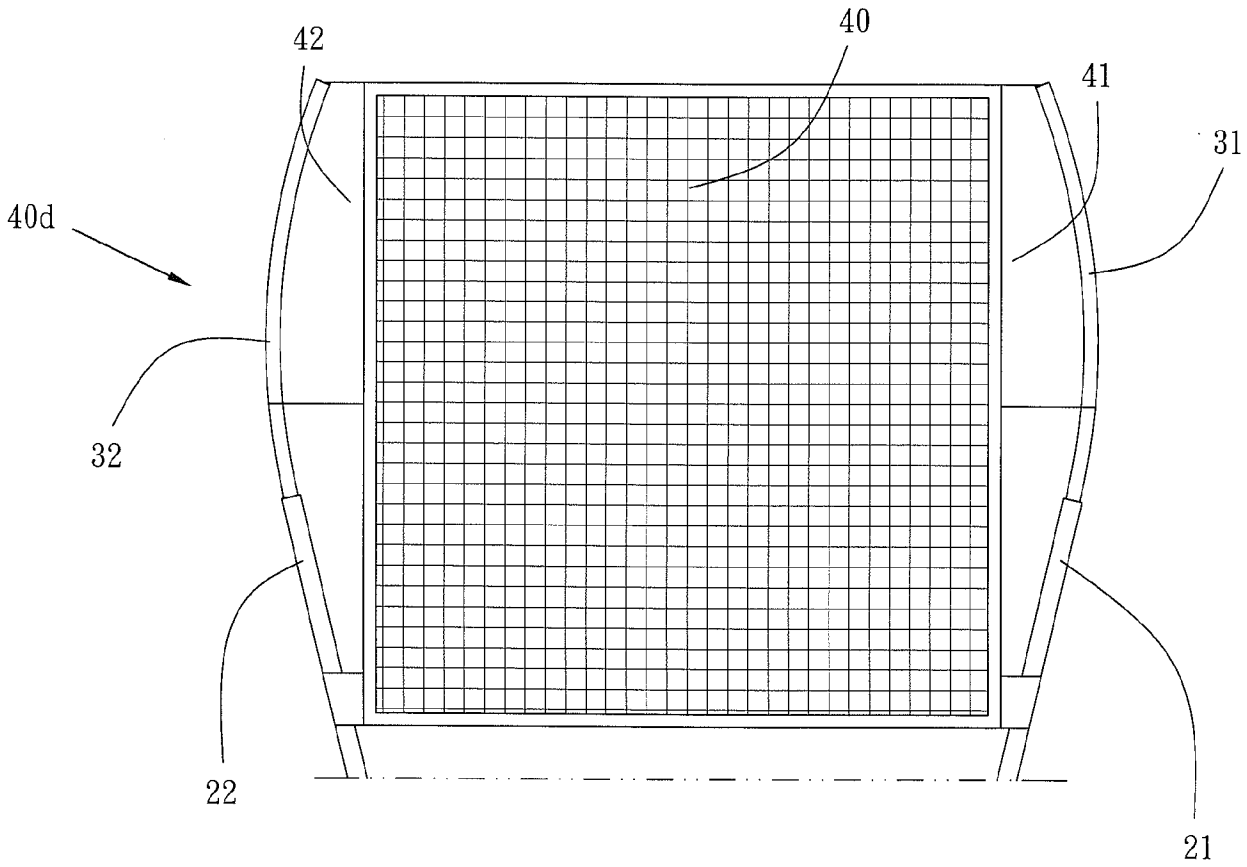
FIG. 6 is a front view of the ball net structure which comes in the form of a baseball training net body according to an embodiment of the present invention.
Figure 7:
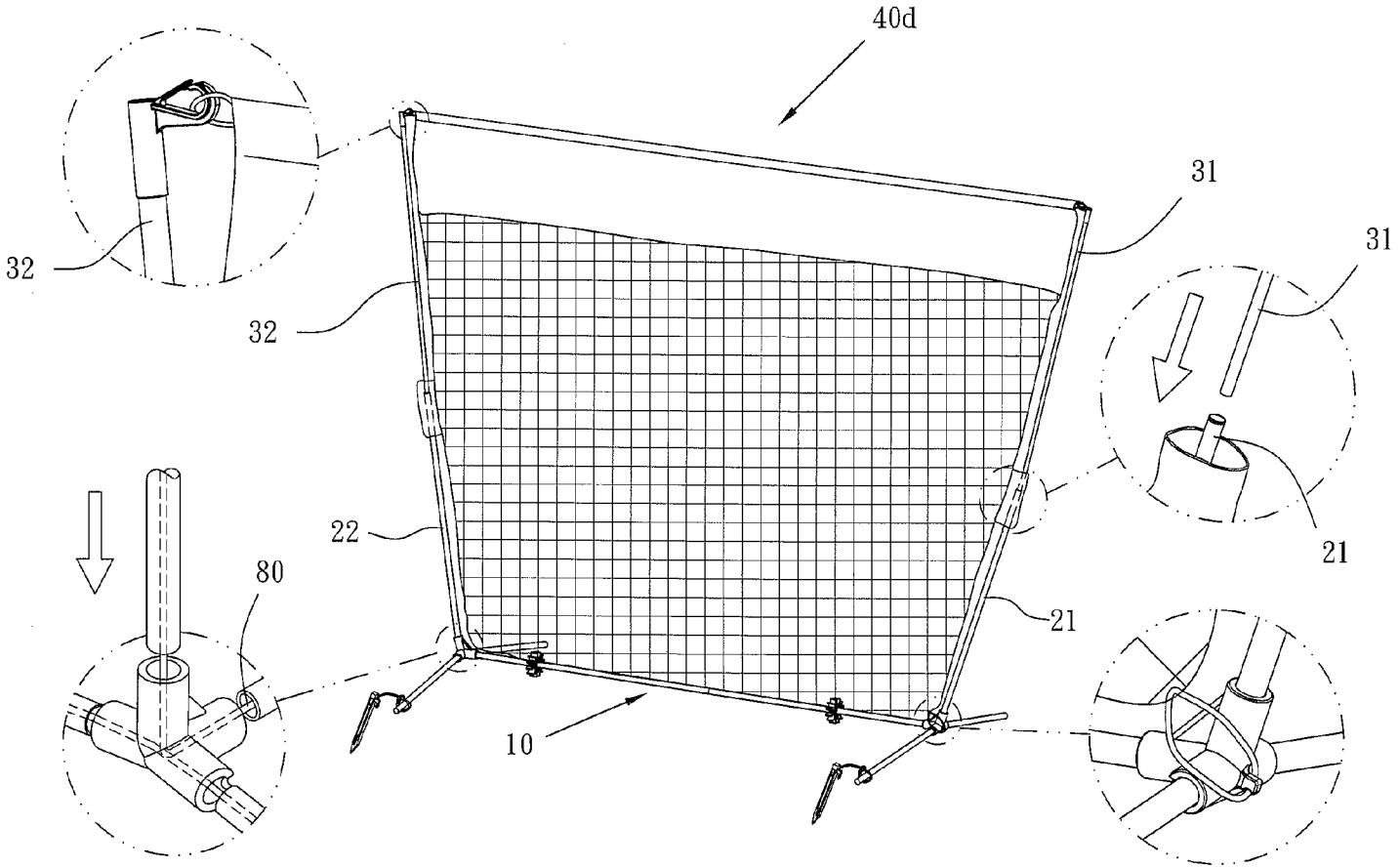
FIG. 7 is a perspective schematic view of the ball net structure which comes in the form of a baseball training net body according to another embodiment of the present invention.

Referring to FIGS. 6, 7, the ball net structure of the present invention comes in the form of the baseball training net body 40*d*. The insertion ends 311, 321 of the two resilient rods 31, 32 are inserted into the two tilted metallic pipes 21, 22, respectively. Then, the two resilient rods 31, 32 are engaged with the first edge 41 and the second edge 42 of the baseball training net body 40*d*, respectively, in a manner that the two resilient rods 31, 32 bend to produce a uniform outward tensile force under which the baseball training net body 40*d* is kept flat and tight.

The elastic cord 80 penetrates the two tilted metallic pipes 21, 22 and the base 10 of the baseball training net body 40*d* and is pulled during an assembly process to enable constituent components to be mounted quickly, thereby dispensing with the hassle of looking for the constituent components.

Figure 8:
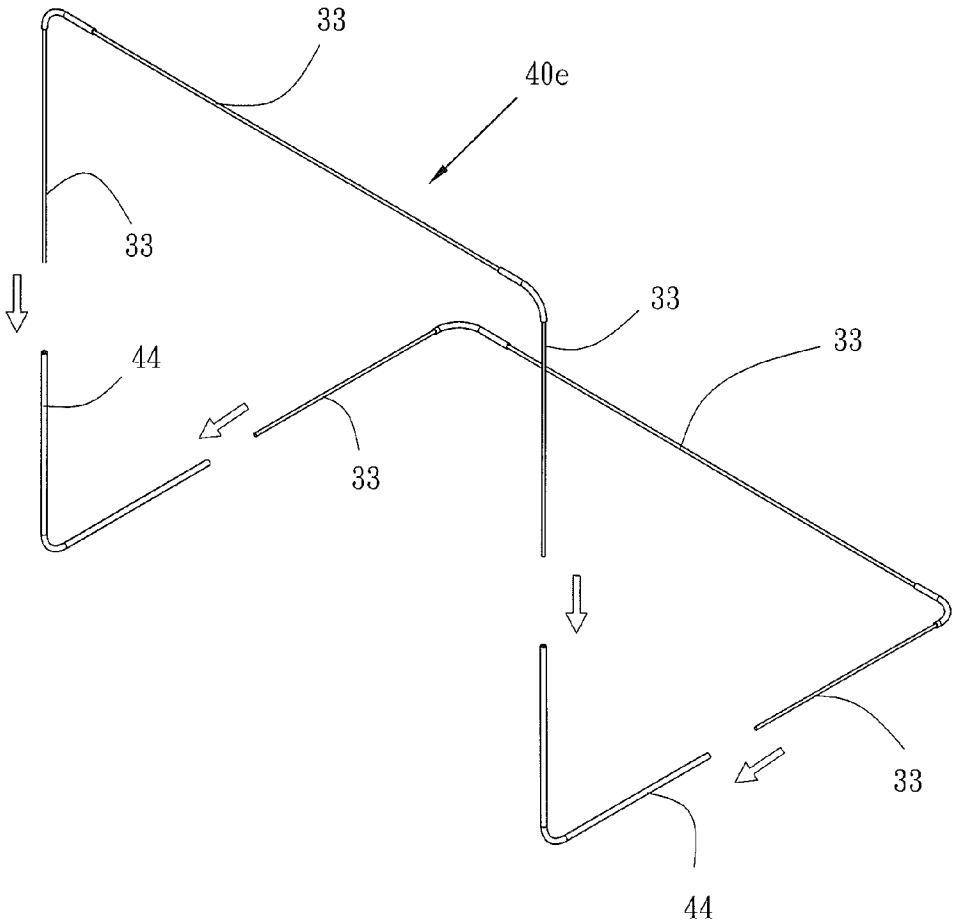
FIG. 8 is a perspective exploded schematic view of the ball net structure which comes in the form of a soccer goal frame according to an embodiment of the present invention.
Figure 9:
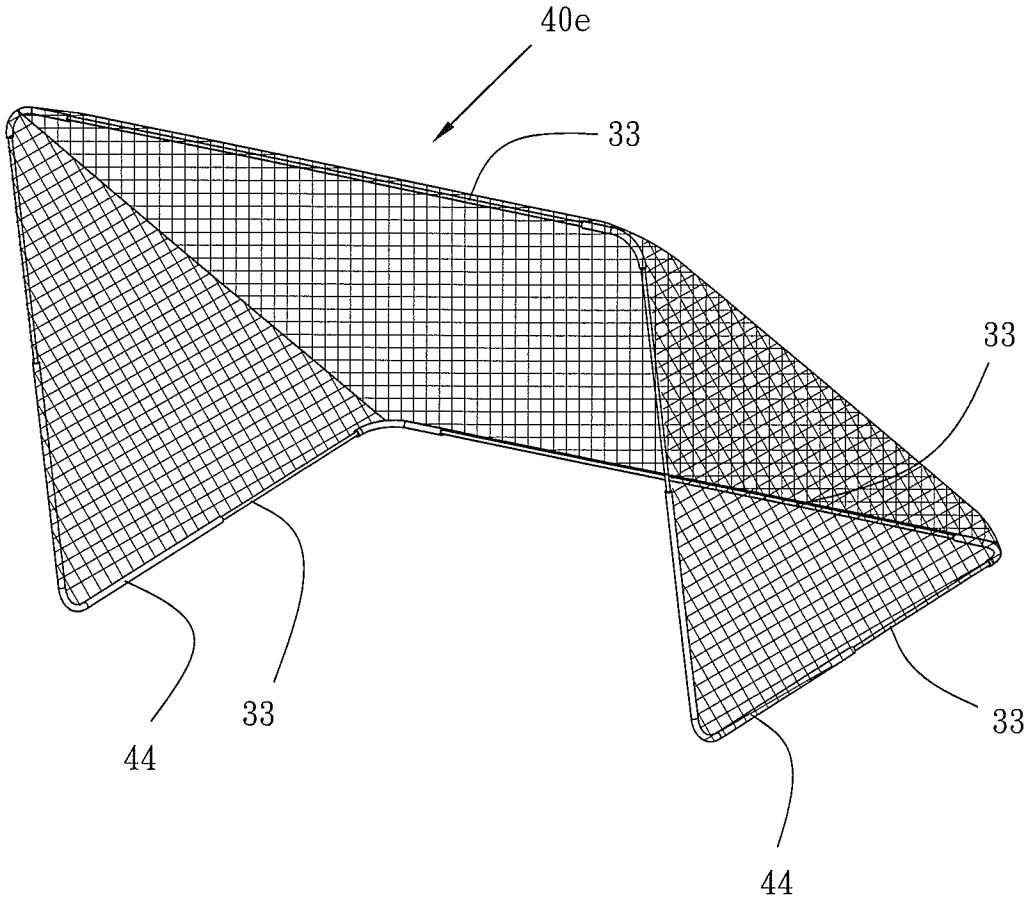
FIG. 9 is a perspective schematic view of the ball net structure which comes in the form of a soccer goal according to an embodiment of the present invention.
Figure 10:
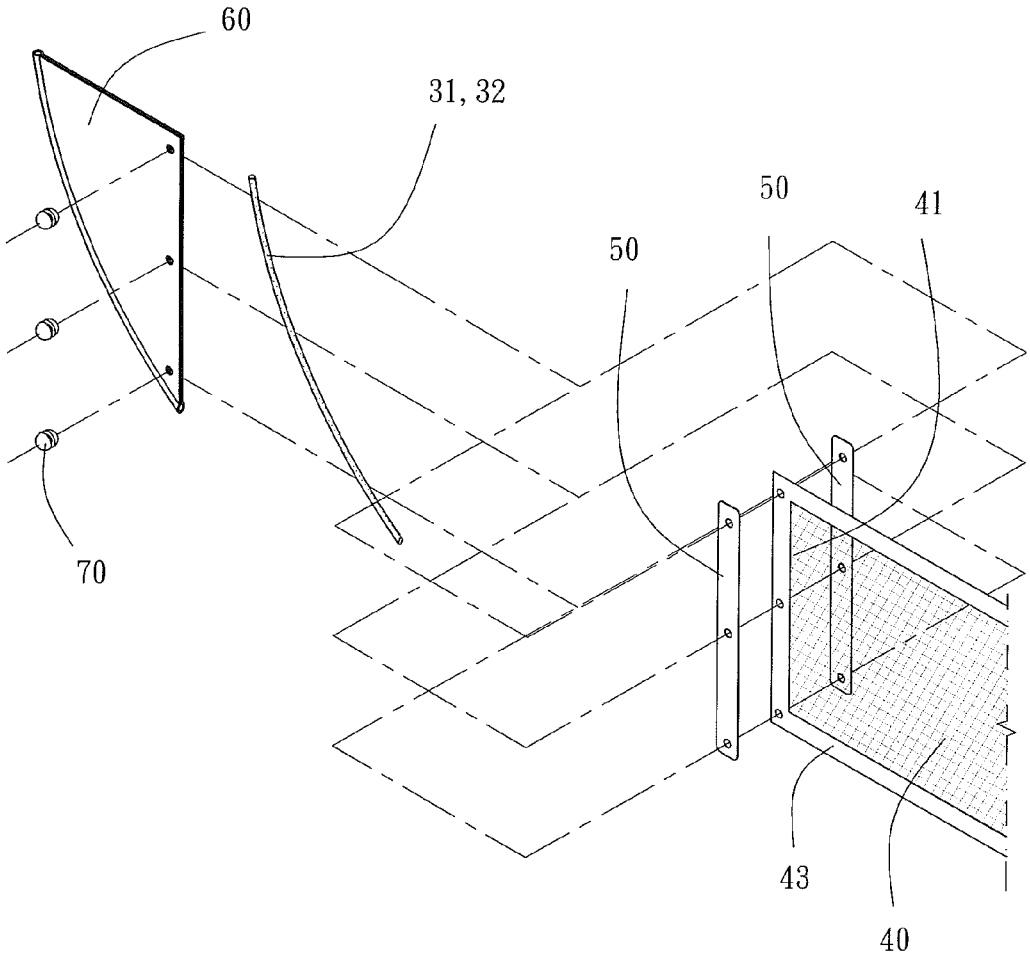
FIG. 10 is a perspective exploded schematic view of the ball net structure according to another embodiment of the present invention.
Figure 11:
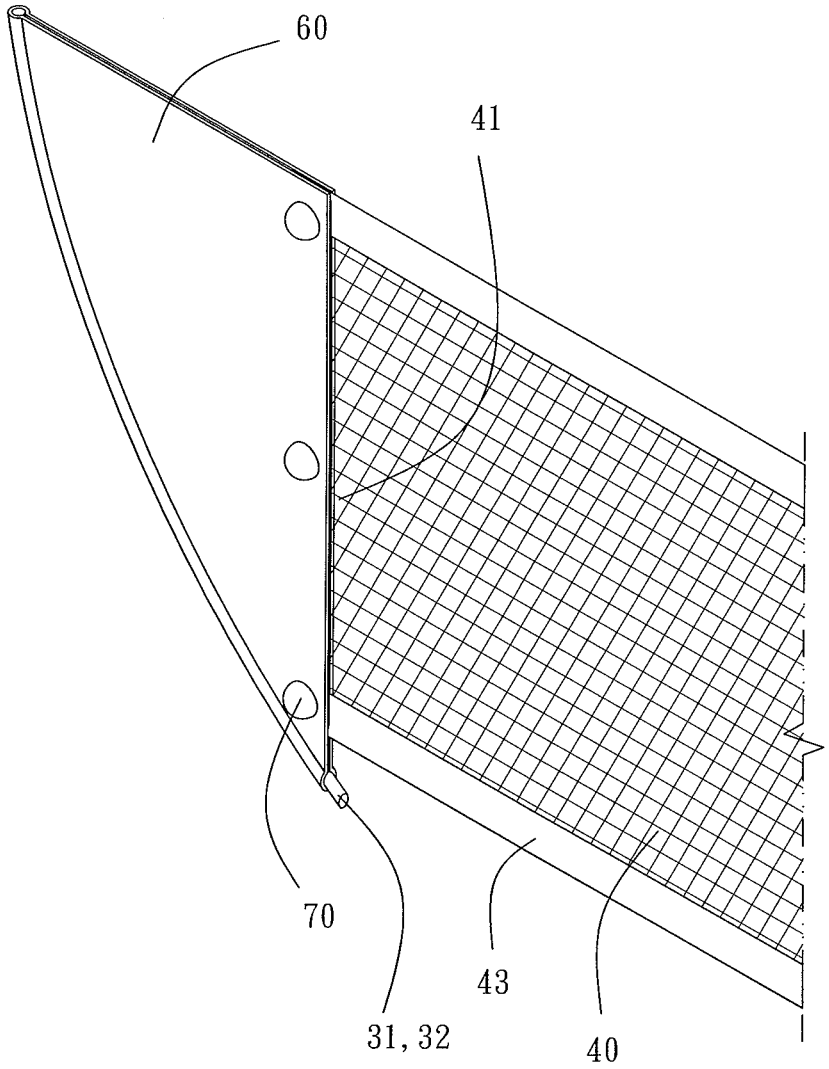
FIG. 11 is a perspective schematic view of the ball net structure according to another embodiment of the present invention.
Figure 12:
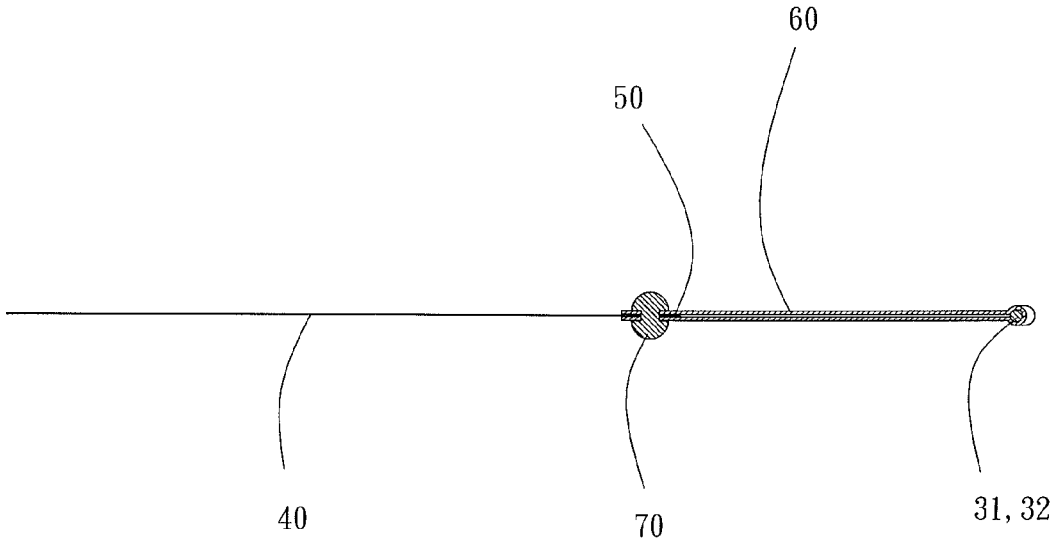
FIG. 12 is a plan cross-sectional view of the ball net structure according to another embodiment of the present invention.

Referring to FIGS. 8, 9, the frame of a soccer goal net body 40*e* comprises metallic pipes 44 and resilient rods 33 inserted thereinto, retractable therefrom, and positioned therein, respectively, to thereby maximize the volume of the soccer goal net body 40*e* when in use and minimize the volume of the soccer goal net body 40*e* when not in use.

The resilient rods 31, 32 of the ball net structure are each a carbon fiber rod.

The resilient rods 31, 32 of the ball net structure are each a glass fiber rod.

The resilient rods 31, 32 of the ball net structure are each a plastic rod.

Referring to FIG. 10 through FIG. 13, the present invention provides a ball net structure including the net body 40, two clamping elements 50, two net-clamping shells 60, and a fixing structure.

The net body 40 has the first edge 41 and the second edge 42. The four edges of the net body 40 are each edged with a plastic sheet edge-binder 43.

The first edge 41 and the second edge 42 are each clamped by and between the two clamping elements 50.

The net-clamping shells 60 are of high rigidity. The high-rigidity net-clamping shells 60 clamp the two clamping elements 50, the plastic sheet edge-binder 43, and the first edge 41 or the second edge 42 of the net body 40.

The fixing structure is provided in the form of at least two nails 70. The at least two nails 70 are disposed on each of the net-clamping shells 60, spaced apart, and adapted to fix the net-clamping shells 60 in place. Due to the at least two nails 70, the two clamping elements 50, the plastic sheet edge-binder 43, and the first edge 41 or the second edge 42 of the net body 40 bear any force jointly and equally and thus incur uniform distribution, rather than concentration, of stress, thereby extending the service life of the net body 40.

As regards the ball net structure, the at least two nails 70 are preferably three said nails 70, such that the three nails 70 bear any force jointly and equally and thus incur uniform distribution, rather than concentration, of stress, thereby extending the service life of the net body 40.

Figure 13:
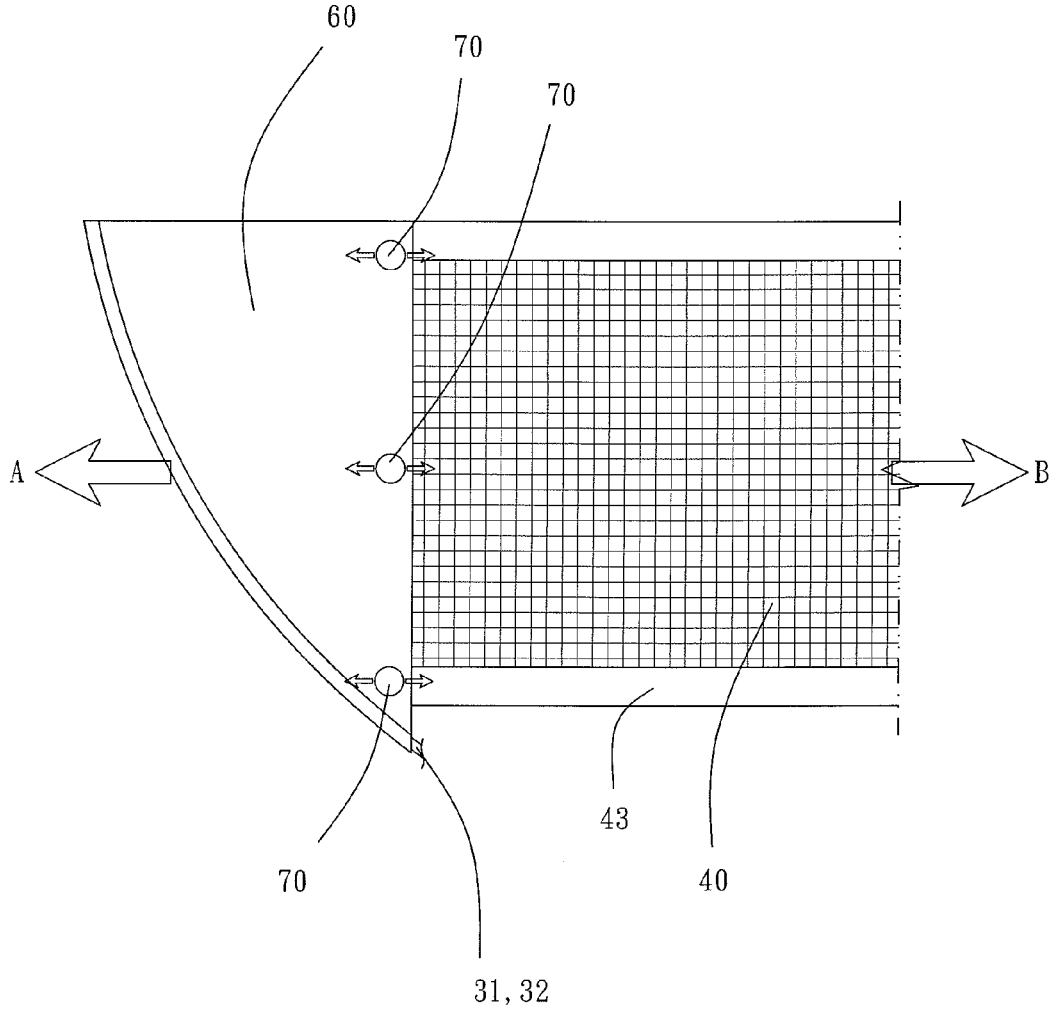
FIG. 13 is a front schematic view of the ball net structure according to another embodiment of the present invention.

Referring to FIG. 13, the resilient rods 31, 32 bend to produce a restoring resilient tensile force. The resilient tensile force is exerted upon the net-clamping shells 60 to cause the net-clamping shells 60 to produce a uniform tensile force A in the direction away from the net body 40. As a result, the net body 40 produces a resisting force B. The three nails 70 each bear one-third of each of the two forces and thus avoid stress concentration, thereby extending the service life of the net body 40.

Figure 14:
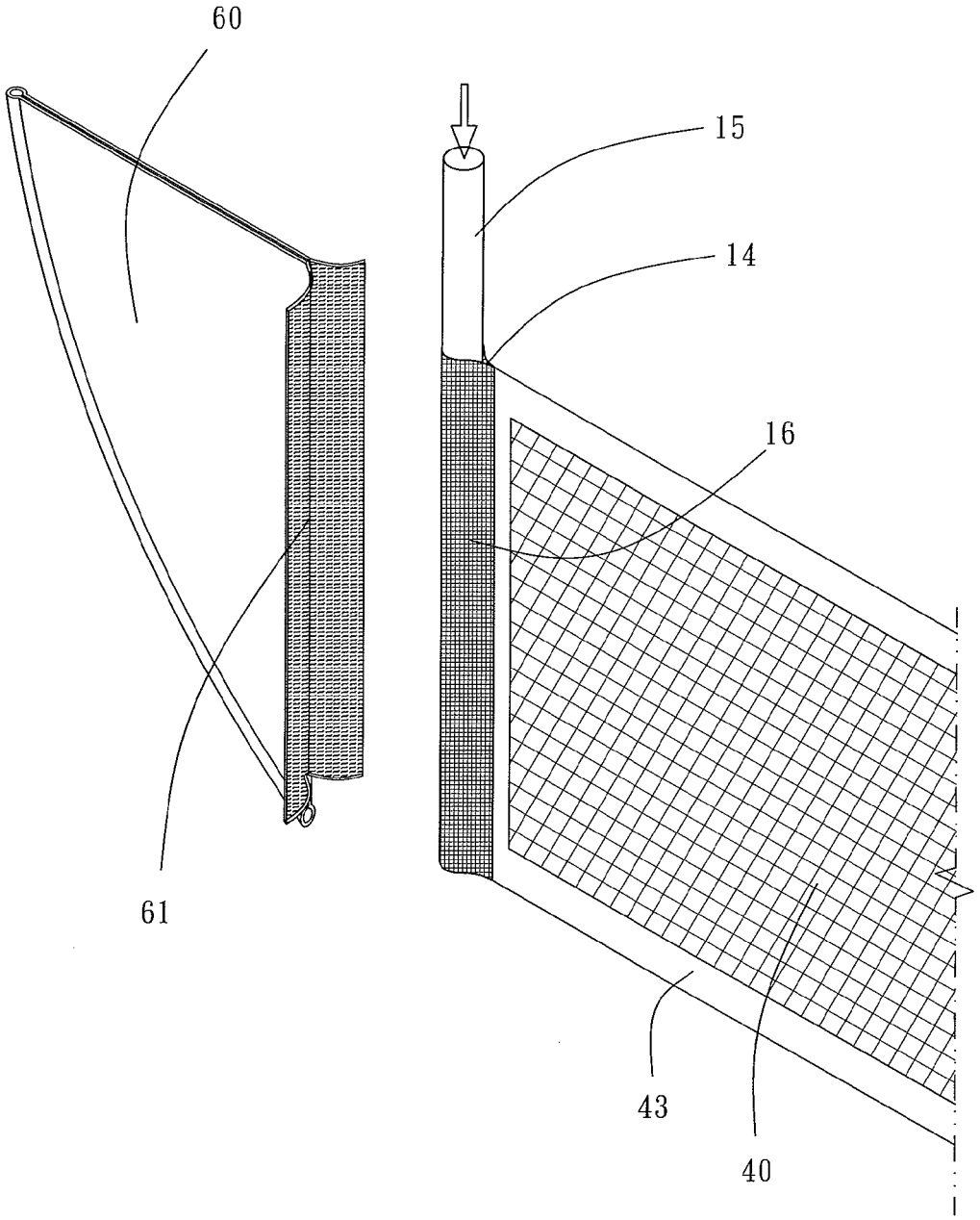
FIG. 14 is a perspective exploded schematic view of the ball net structure according to another embodiment of the present invention.
Figure 15:
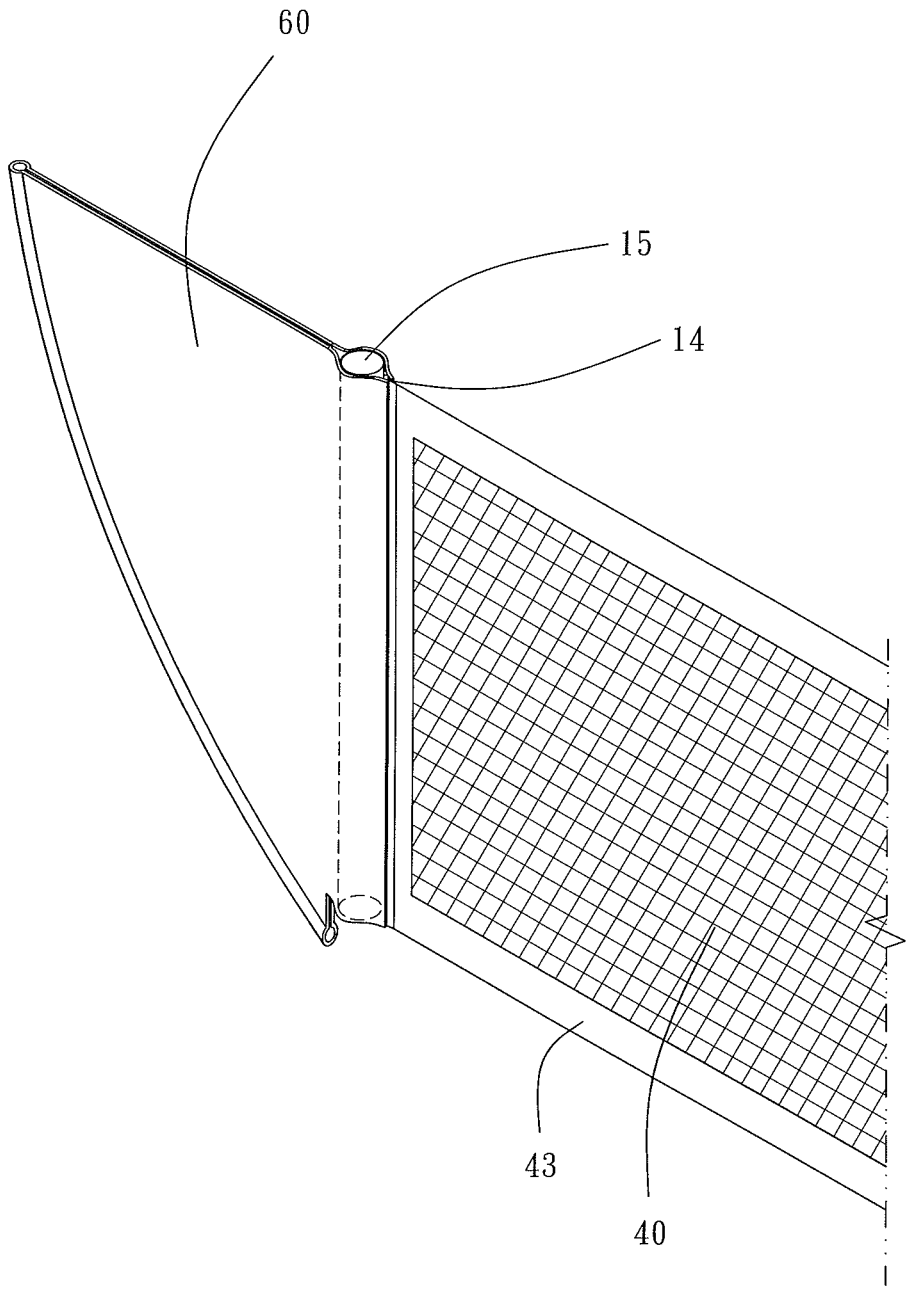
FIG. 15 is a perspective schematic view of the ball net structure according to yet another embodiment of the present invention.

Referring to FIGS. 14, 15, the ball net structure of the present invention comprises the net body 40, the plastic sheet edge-binder 43, and the net-clamping shells 60. The net body 40 has the first edge 41 and the second edge 42. The plastic sheet edge-binder 43 is disposed on each of the four edges of the net body 40. The net-clamping shells 60 are of high rigidity. A Velcro hook-and-loop male side 61 of a fixing structure is disposed on each of the high-rigidity net-clamping shells 60 and faces the plastic sheet edge-binder 43. A cylindrical edge-binder 14 is disposed on one side of the plastic sheet edge-binder 43. The cylindrical edge-binder 14 has therein a plastic post 15 insertedly disposed and is outwardly and circumferentially provided with a Velcro hook-and-loop female side 16 of the fixing structure. Hence, the Velcro hook-and-loop male side 61 matches the plastic post 15 in shape and engages with the Velcro hook-and-loop female side 16. Furthermore, with the net body 40 being tightened, the Velcro hook-and-loop male and female sides 61, 16 produce opposite tensile forces, respectively. The Velcro hook-and-loop male side 61 can be curved to match the arcuate surface of the plastic post 15 for the sake of engagement with the Velcro hook-and-loop female side 16, and thus the Velcro hook-and-loop male side 61 features a large engagement area as well as arcuate multidirectional force components to thereby reduce the tensile forces but enhance the binding forces of the Velcro hook-and-loop male and female sides 61, 16.

Therefore, the ball net structure of the present invention is novel and innovative and thus meets the requirements of patentability, such as novelty and inventiveness. Furthermore, the ball net structure of the present invention is characterized by an optimal ratio of rigid metallic pipe to flexible resilient rod by length, such that the high-flexibility resilient rods not only bend to attain optimal curvature but also produce the largest and evenest tensile force. The ball net structure of the present invention is further characterized by two high-rigidity net-clamping shells which clamp the plastic sheet edge-binder and the first edge or the second edge of the net body and are fixed in place with at least two nails to thereby achieve uniform distribution of stress. Hence, the ball net structure of the present invention meets a further patentability requirement, that is, industrial applicability.

What is claimed is:

1. A ball net structure comprising:

a base;

two tilted metallic pipes tilting outward;

two resilient rods each having an insertion end, with the insertion ends inserted into the two tilted metallic pipes, respectively, and fixed in place, with the two tilted metallic pipes being longer than the two resilient rods made from spherical fiber or carbon fiber, to enable the two resilient rods to bend to achieve optimal curvature and produce an evenest and largest tensile force;

a net body having a first edge and a second edge which are disposed around the two resilient rods, respectively, with the two resilient rods bending to produce a uniform outward tensile force for keeping the net body flat and tight, wherein a plastic sheet edge-binder is disposed on each of four edges of the net body;

two net-clamping shells for clamping the plastic sheet edge-binder and the first edge or the second edge of the net body; and a fixing structure disposed on each of the net-clamping shells and adapted to fix the net-clamping shells in place, thereby allowing the plastic sheet and one of the first edge and the second edge of the net body to bear any force jointly and equally and incur uniform distribution, rather than concentration, of stress, thereby extending the service life of the net body, wherein a cylindrical edge-binder is disposed at one of the first edge and the second edge, has therein a plastic post insertedly disposed, and is outwardly and circumferentially provided with a hook-and-loop female side of the fixing structure, wherein the hook-and-loop female side of the fixing structure is disposed at a periphery of the cylindrical edge-binder, with the net-clamping shells being of high rigidity, wherein a hook-and-loop male side of the fixing structure is disposed in a manner to face a direction in which the high-rigidity net-clamping shells clamp the plastic sheet edge-binder, wherein the hook-and-loop male side matches the plastic post in shape and engages with the hook-and-loop female side, wherein, with the net body being tightened, the hook-and-loop male and female sides produce opposite tensile forces, respectively, to enable the hook-and-loop male side to be curved to match an arcuate surface of the plastic post for engagement with the hook-and-loop female side, thereby enabling the hook-and-loop male side to have a large engagement area and arcuate multidirectional force components to thereby reduce the tensile forces but enhance a binding forces of the hook-and-loop male and female sides.

2. The ball net structure of claim 1, wherein the net body is one of a volleyball net body, a badminton net body, a beach volleyball net body, a baseball training net body, and a tennis net body.

3. The ball net structure of claim 1, wherein an elastic cord penetrates the base and the two tilted metallic pipes and is coupled to the two resilient rods to thereby not only enable the two resilient rods to be dismounted quickly but also enable the resilient rods to be mounted quickly in an assembly process while the elastic cord is being pulled.

4. The ball net structure of claim 1, wherein the insertion ends of the two resilient rods come in a form of retractable portions, respectively, for the two resilient rods to be connected easily to hollow inner holes inside the tilted metallic pipes, respectively.

5. The ball net structure of claim 4, wherein convolutions are disposed at a periphery of the retractable portions, and wherein the two resilient rods are coupled firmly to the two tilted metallic pipes, respectively.

6. The ball net structure of claim 1, wherein the two resilient rods are each a carbon fiber rod.

7. The ball net structure of claim 1, wherein the two resilient rods are each a glass fiber rod.

8. The ball net structure of claim 1, wherein the two resilient rods are each a plastic rod.

9. The ball net structure of claim 1, wherein the net body is a soccer goal net body comprising a frame, with the frame comprising metallic pipes and resilient rods inserted thereinto, retractable therefrom, and positioned therein, respectively, to thereby maximize volume of the soccer goal net body when in use and minimize volume of the soccer goal net body when not in use.

10. The ball net structure of claim 1, wherein the two net-clamping shells are of high rigidity.

11. The ball net structure of claim 1, wherein one of the first edge and the second edge is clamped by and between two clamping elements, with the two clamping elements clamped by and between the two net-clamping shells and fixed in place with at least two nails.

12. The ball net structure of claim 11, wherein the at least two nails are provided in a form of three nails, wherein the three nails enable the two clamping elements, the plastic sheet edge-binder, and one of the first edge and the second edge of the net body to bear any force jointly and equally and thus incur uniform distribution, rather than concentration, of stress, thereby extending the service life of the net body.

* * * * *